US005538676A

United States Patent [19]

Bielfeldt

[11] Patent Number: 5,538,676

[45] Date of Patent: Jul. 23, 1996

[54] PROCESS AND PLANT FOR THE CONTINUOUS PRODUCTION OF PARTICLEBOARDS

[75] Inventor: Friedrich B. Bielfeldt, Pähl, Germany

[73] Assignee: Maschinenfabrik J. Dieffenbacher GmbH & Co., Eppingen, Germany

[21] Appl. No.: 310,389

[22] Filed: Sep. 22, 1994

[30] Foreign Application Priority Data

Oct. 1, 1993 [DE] Germany ..... 43 33 614.0

[51] Int. Cl.[6] ..... B27N 3/22; B27N 3/24

[52] U.S. Cl. ..... 264/109; 264/280; 156/555; 156/583.3; 156/583.5; 100/74; 100/93 P; 100/93 RP

[58] Field of Search ..... 264/109, 112, 264/280; 156/583.3, 583.5, 555; 100/73, 74, 93 P, 93 RP

[56] References Cited

U.S. PATENT DOCUMENTS

| | | | |
|---|---|---|---|
| 4,111,744 | 9/1978 | Reiniger | 264/120 |
| 5,063,010 | 11/1991 | Fischer et al. | 264/109 |
| 5,195,428 | 3/1993 | Gawlitta et al. | 100/73 |
| 5,284,546 | 2/1994 | Tilby | 100/93 RP |

*Primary Examiner*—Robert A. Dawson
*Assistant Examiner*—Kenneth M. Jones
*Attorney, Agent, or Firm*—Foley & Lardner

[57] ABSTRACT

A process and a plant for the continuous production of particleboards and fiberboards, in which a particle mat of a mixture of large-area oriented wood particles and a phenolic resin binder is scattered onto a conveyor, moistened with steam, preheated, and pressed between heated press platens of a continuously operating press using pressure and heat to form a particleboard or a fiberboard.

13 Claims, 1 Drawing Sheet

PROCESS AND PLANT FOR THE CONTINUOUS PRODUCTION OF PARTICLEBOARDS

BACKGROUND OF THE INVENTION

The invention relates to a process for the continuous production of particleboards or fiberboards, in which a particle mat of a mixture of large-area oriented wood particles and a phenolic resin binder is scattered onto a conveyor belt and pressed between heated press platens of a continuously operating press using pressure and heat to form a particleboard or fiberboard broadly, a particleboard/fiberboard.

The invention furthermore relates to a plant for carrying out the process of the invention.

The pressing factor in the processing of such OS (oriented strand) boards is about twice as high as in normal particleboard production. For this reason, the production of OS boards was only economic on multiplaten plants having a very high number of platens. For the same reason, the use of continuously operating presses has hitherto not become established, because, as a result of the very high pressing factor, excessively long presses would have to be used which would mean excessively high capital investment in comparison with productivity. Despite the limitations, the ready-built house industry in particular demands both particleboards having a smooth surface and particleboards in which at least one side has a surface structure in the form of a screen impression of a woven or knitted metal wire screen.

The woven metal wire screen here has two functions: (i) to transport the coarse wood chips scattered onto the woven metal wire belt, which chips cannot be precompacted, for example in continuous double-band presses, sufficiently for further transport at belt transitions to be possible, and (ii) to provide a surface structure on the pressed OS boards which are functionally designed for later further processing, for example in the ready-built house industry.

The high pressing factor required in the processing of such OS boards is caused by the deleterious influence of the coarse particle structure and by the following:

the processing of all wood-based boards, such as particleboards, MDF (medium density fiber) boards or OS boards, is carried out technologically according to the principles that the wood particles, in this case the large-area oriented particles for the OS boards, are wetted by moist, liquid resin components (for example, phenolic resin binders) and, as a result of the presence of water, the heating of the particle mat in the press causes this water to vaporize and, as a result of the steam formation, in particular in the core of the boards to be produced, a temperature environment is produced which is $\geqq 100°$ C.

In the normal production of particleboards or MDF boards, the particle mat is enclosed by smooth press surfaces (wood plates or steel bands), and a pressure greater than 1 bar can form between the large-area pressing zones. According to the vapor pressure graph, the temperature increases with increasing steam pressure and in general, a temperature level of about 120° C. is established in the core of the boards between the upper and lower press surfaces. The steam pressures of greater than 1 bar result in an accelerated steam transfer from the outer layers to the middle layers, which causes accelerated curing, particularly in the core of the boards.

In the production of OS boards, as a result of the woven metal wire belt, this increased steam pressure cannot become established because the woven belt does not allow a buildup of pressure, so that there is formation of only wet steam in the range around 100° C. As a result, accelerated curing in the core of the board is not possible. This leads in the end to the increased requirements of pressing factors to about twice as high as in the case of normal particleboard manufacture.

To further limit the buildup of steam temperature and pressure, the woven metal wire belt and the particle mat have to be heated in the heated pressing zones from a transport temperature of from about 20° to 40° C. to the production temperature in the heated pressing zones. This too causes a reduction in the pressing factor. Furthermore, the woven metal wire belt, at least on the woven metal side, results in poorer heat transfer from the bottom heating plate to the material being pressed.

DE-C 41 37 845 discloses an improvement of the pressing factor in multiplaten presses by arranging a surface structure-forming screen having a woven metal wire belt or knitted metal wire mesh between at least one of the press platens and the particle mat, which screen has a circumferential sealing edge strip, and by orienting the mat to be pressed and the sealing edge strip in relation to one another in such a way that the sealing edge strip is flush with the particle mat or the particle mat projects by some centimeters in its edge region. The sealing edge strip is arranged in such a way that, during the pressing process, it largely or completely prevents the escape of liberated steam. This leads to the mat subjected to the pressing process having a very much more homogeneous temperature distribution than when carrying out the pressing process using a screen without such an edge seal. However, this disclosure does not suggest how the pressing factor can be improved when pressing OS boards in a continuously operating press. Rather, there is still the view among those skilled in the art that large-area, oriented wood particles cannot be economically processed in continuously operating presses to give particleboards.

SUMMARY OF THE INVENTION

One object of this invention is to provide a process by which means the continuous production of particleboards having a surface structure of a woven metal wire belt on at least one side is made possible with a pressing factor which can be achieved at present in particleboard manufacture on known continuously operating presses.

Another object of this invention is to improve by the process of the first object the pressing factor to such a degree that economical production of particleboards from a particle mat comprising large-area oriented wood particles is possible in a continuously operating press.

Still another object of this invention is to provide a plurality of woven metal wire belts having different widths to produce particleboards with different widths.

Still another object of the invention is to provide a plant to carry out the process of the aforementioned objects.

The aforementioned objects are achieved by the following measures.

To promote wet steam formation in the particle mat, a moistening device is provided after the scattering station and a preheating zone is provided thereafter. This spray-moistening is preferably carried out in the lower region of the particle mat through the woven metal wire belt. The moistening can furthermore be intensified by an additional spraying station prior to the scattering station. This means that, prior to scattering the particle mat, the woven metal wire belt is exposed to a fine spray from above.

The moisture content of the wood particles can be advantageously controlled as follows. From the scattering station the wood particles are provided with a moisture content below the standard moisture content of from 9% to 12%, for example ≦9%, while, by means of the spray stations, the covering layers have their moisture content increased by sprayed water, so that an average moisture content of about 12% is finally established.

The preheating zone is constructed as a heating tunnel and is arranged directly before entry into the continuously operating press, so that after leaving the preheating zone the particle mat is directly fed into the continuously operating press. The main purpose of these measures is that the woven metal wire belt is preheated to at least 100° C. and the particle mat thus experiences preheating to at least from 60° C. to 80° C. The preheating zone is preferably constructed as a heating plate of metal over which the woven metal wire belt slides. Owing to the good heat transfer between the metal materials, a good heat transfer into the particle mat results. The length of the preheating zone is designed so that, corresponding to the production speed of the conveyor belt running over it, the moist particle mat is heated to the wet steam temperature of about 100° C., at least on the bottom covering layer. The whole preheating zone is provided with a thermally insulated hood which prevents drying out of the particle mat. As a result of the edge-strip sealing of the woven metal wire belt, the required steam pressure and a temperature level of 120° C. can furthermore become established in the interior of the particle mat. The measures and process steps of the invention result in achievement of a pressing factor in the production of OS boards which is possible at present in particleboard manufacture on continuously operating presses.

The plant for carrying out the process according to the invention comprises:

a continuous woven metal wire belt which has impermeably sealed edge regions, a device for scattering the particle mat of the mixture in a continuous manner on the woven metal wire belt, the particle mat having a moisture content of ≦9%, a steam moistening device for treating the particle mat with hot steam to give the particle mat a moisture content of about 12%, a press having two heated press platens for pressing the particle mat therebetween to form a particleboard/fiberboard, a preheating zone, located directly upstream of the press, for heating the woven metal wire belt thereby heating a bottom covering layer of the particle mat to a wet steam temperature of about 100° C. and heating the particle mat to a temperature ranging from 60° C. to 80° C., wherein the press platens define a gap and wherein the press further includes a movable press ram which adjusts the press gap, a press table, and two continuous steel bands transmitting the pressing pressure which are guided by the press ram and press table via drive and deflecting rollers.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

The accompanying drawings, which are incorporated in and constitute a part of the specification, illustrate presently preferred exemplary embodiments of the invention, and, together with the general description given above and the detailed description of the preferred embodiment given below, serve to explain the principles of the invention.

DETAILED DESCRIPTION OF THE PREFERRED EMBODIMENT

The embodiment of the present invention is explained below with reference to the accompanying drawings.

Figure 1:
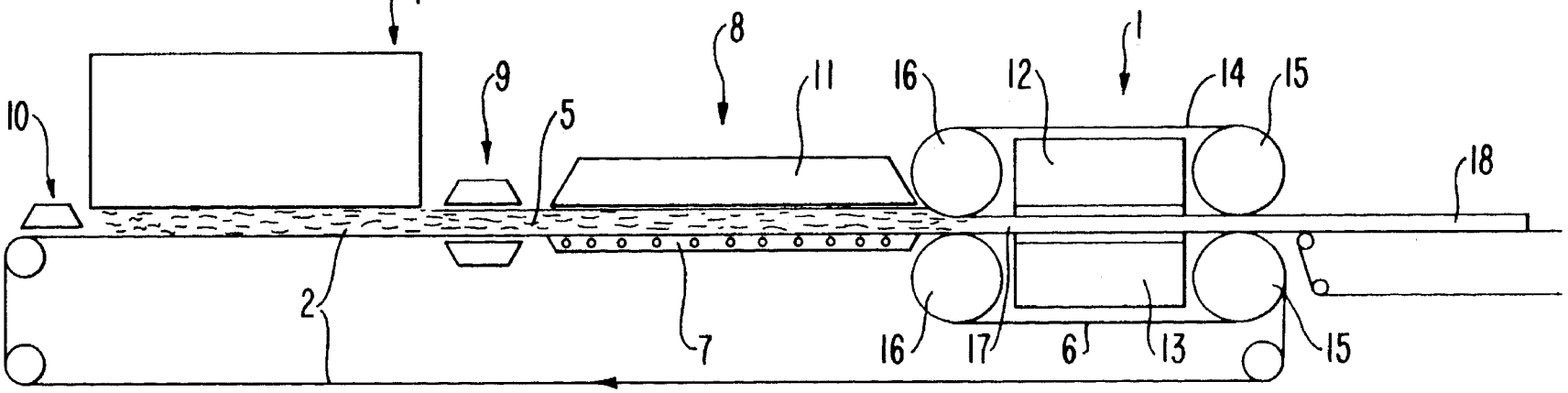
FIG. 1 schematically shows the plant for the process of the invention.

FIG. 1 schematically shows the plant in which the particle mat 5 comprising large-surface oriented wood particles is scattered onto a woven metal wire belt 2 from the scattering station 4. The woven metal wire belt 2 here serves as a conveyor belt for the further conveyance of the particle mat 5 through a moistening device 9, a preheating zone 8 and finally through the continuously operating press 1. Constructed as a continuous conveyor belt, the woven metal wire belt 2 is subsequently led back under the continuously operating press 1 to the scattering station 4. Upstream of the scattering station 4, there is arranged another spraying device 10 for moistening the wire surfaces of the woven metal wire belt 2. The preheating zone 8 comprises a heating plate 7 and, arranged above it, a covering hood 11 of insulating material, so that it can be described as a heating tunnel. The continuously operating press 1 can be a so-called double-band press, the main components of which are a movable press ram 12 and a fixed press table 13 which form the adjustable press gap 17. Press ram 12 and press table 13 have steel bands 6 and 14 running around them via drive rollers 15 and deflecting rollers 16. The heated press platens (not shown) are applied to the sides of the press ram 12 and the press table 13 facing the press gap 17. The finished particleboard leaving the continuously operating press 1 is denoted by 18.

Figure 2:
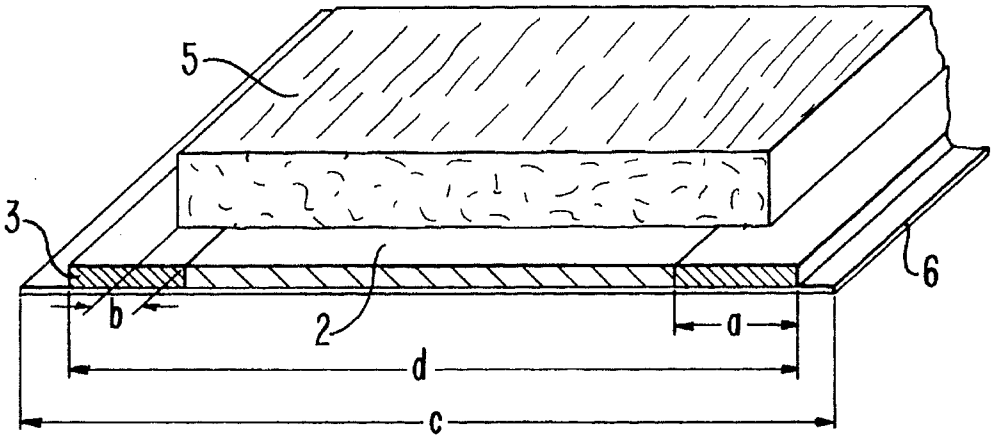
FIG. 2 schematically shows the configuration of the woven metal wire belt in perspective view on an enlarged scale.

FIG. 2 shows the structural configuration of the woven metal wire belt 2 as a conveyor belt and surface-structure-forming screen belt for the particle mat 5 and the finished particleboard 18. The woven metal wire belt 2 is sealed in the two edge regions as edge strips "a" with a heat-resistant plastic composition 3, for example TEFLON (polytetrafluoroethylene). During transport through the plant and the continuously operating press 1, the particle mat 5 about half covers the sealed edge strip "a" to a distance of b=a/2. The overlap width b is about ≦60 mm. The continuous traveling steel band 6 in the continuously operating press 1 has a constant working width c determined by the machine. In contrast, the woven metal wire belt 2 can, corresponding to the desired different board widths which are to be produced in the continuously operating press 1, be matched to the width d of the production strip by exchange of the woven metal wire belt 2.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A process for the continuous production of particleboards/fiberboards, in which a particle mat, formed of a mixture of large-area oriented wood particles and liquid resin components scattered onto a continuous woven metal wire belt which has impermeably sealed edge regions, is pressed between heated press platens of a continuously operating press using pressure and heat to form a particleboard/fiberboard, the process comprising the steps of:

scattering the particle mat of the mixture in a continuous manner on the woven metal wire belt;

moistening a surface of the woven metal wire belt before scattering the particle mat thereon;

subsequently treating the particle mat in a steam moistening device with hot steam to give the particle mat a moisture content of about 12%;

heating the woven metal wire belt in a preheating zone directly before entry of the particle mat into a pressing region, thereby heating a bottom covering layer of the particle mat to a wet steam temperature of about 100° C., and heating the particle mat to a temperature ranging from 60° C. to 80° C.; and pressing the particle mat between the heated press platens to form a particleboard/fiberboard.

2. The process for the continuous production of particleboards/fiberboards as recited in claim 1, wherein the liquid resin components are phenolic resin binders.

3. A plant for the continuous production of particleboards/fiberboards from a particle mat of a mixture of large-area oriented wood particles and liquid resin components, comprising:

a continuous woven metal wire belt, which has impermeably sealed edge regions, adapted to convey the particle mat;

a device for scattering the particle mat of the mixture in a continuous manner on the woven metal wire belt, the particle mat having a moisture content of ≦9%;

a spraying device which wets the woven metal wire belt before the belt reaches the scattering device;

a steam moistening device, located downstream of the scattering device, for treating the particle mat with hot steam to give the particle mat a moisture content of about 12%;

a press, located downstream of the scattering device, having two heated press platens for pressing the particle mat therebetween to form a particleboard/fiberboard; and a preheating zone, located directly upstream of the press, for heating the woven metal wire belt thereby heating a bottom covering layer of the particle mat to a wet steam temperature of about 100° C. and heating the particle mat to a temperature ranging from 60° C. to 80° C.

4. A plant for continuous production of particleboards/fiberboards as recited in claim 3, wherein the woven metal wire belt has two edge regions and, in each said edge region, an edge strip sealed with a heat-resistant plastic composition.

5. A plant for continuous production of particleboards/fiberboards as recited in claim 4, wherein the heat-resistant plastic composition is polytetrafluoroethylene.

6. A plant for continuous production of particleboards/fiberboards as recited in claim 5, wherein the particle mat overlaps the edge strip by about half a width of the edge strip, the overlap ranging from 40 mm to 60 mm.

7. A plant for the continuous production of particleboards/fiberboards as recited in claim 3, wherein the liquid resin components are phenolic resin binders.

8. A plant for the continuous production of particleboards/fiberboards as recited in claim 3, wherein the press platens define a gap therebetween and wherein the press further includes a movable press ram which adjusts the press gap, a press table opposite the movable press, and two continuous steel bands transmitting the pressing pressure which are guided by the press ram and press table via drive and deflecting rollers.

9. A plant for continuous production of particleboards/fiberboards as recited in claim 3, wherein the woven wire belt is selected from a plurality of woven metal wire belts having different widths provided to produce particleboards/fiberboards of correspondingly different widths.

10. A plant for continuous production of particleboards/fiberboards as recited in claim 3, wherein said preheating zone comprises a heating plate of metal over which the woven metal wire belt slides, and a thermally insulated hood covering the heating plate.

11. A plant for continuous production of particleboards/fiberboards as recited in claim 3, wherein the steam moistening device sprays a bottom region of the particle mat through the woven metal belt.

12. A plant for continuous production of particleboards/fiberboards as recited in claim 3, wherein the spraying device wets the woven metal wire belt with steam from above.

13. A system for carrying out the process as claimed in claim 1, the system comprising in order:

a spraying device;

a scattering station;

the steam moistening device;

the preheating zone; and the continuously operating press, the press including a movable pressing ram which adjusts a press gap, a pressing table opposite the movable pressing ram, and two endless steel belts which are entrained about driving and deflecting rollers of the pressing ram and pressing table and which transmit pressing pressure;

wherein the spraying device, the scattering device, the steam moistening device, the preheating zone, and the continuously operating press are connected by the continuous woven metal wire belt which runs through and around them and which has in each of its two edge regions an edge strip sealed with a heat-resistant plastic composition.

* * * * *